US005163825A

United States Patent [19]

Oetting

[11] Patent Number: 5,163,825

[45] Date of Patent: Nov. 17, 1992

[54] ARTICULATED VANE FLUID DRIVEN MOTOR

[76] Inventor: Roy E. Oetting, 608 Lincoln St., Sayre, Pa. 18840

[21] Appl. No.: 680,154

[22] Filed: Apr. 3, 1991

[51] Int. Cl.[5] ..... F01C 1/18

[52] U.S. Cl. ..... 418/153; 418/154; 418/176; 418/268

[58] Field of Search ..... 418/153, 156, 155, 176, 418/268

[56] References Cited

U.S. PATENT DOCUMENTS

| | | | |
|---|---|---|---|
| 156,814 | 10/1874 | Peck | 418/268 |
| 420,094 | 1/1890 | Payne | 418/249 |
| 646,420 | 4/1900 | Doran | 418/268 |
| 823,020 | 6/1906 | Allan | 418/268 |
| 969,378 | 9/1910 | Krause | 418/268 |
| 971,043 | 9/1910 | Hoffman | 418/176 |
| 1,818,430 | 8/1931 | Ricardo | 418/172 |
| 1,942,784 | 1/1934 | Terrill | 418/268 |
| 2,011,451 | 8/1935 | Lockwood | 418/176 |
| 2,070,738 | 2/1937 | Klein | 418/176 |
| 2,332,411 | 10/1943 | Swanson et al. | 418/156 |
| 2,444,234 | 6/1948 | Stageberg | 418/156 |
| 2,585,354 | 2/1952 | Thorgrimsson | 418/248 |
| 2,636,479 | 4/1953 | Smyser | 418/156 |
| 2,841,090 | 7/1958 | Nuerwell | 418/176 |
| 3,661,480 | 5/1972 | Förschner et al. | 418/206 |
| 3,804,562 | 4/1974 | Hansson | 418/270 |
| 3,881,849 | 5/1975 | Commarmut et al. | 418/152 |
| 4,514,157 | 4/1985 | Nakamura et al. | 418/270 |
| 4,762,480 | 8/1988 | Winkler et al. | 418/270 |
| 4,820,480 | 4/1989 | David | 418/156 |
| 4,975,034 | 12/1990 | Ellis | 418/265 |

FOREIGN PATENT DOCUMENTS

| | | | |
|---|---|---|---|
| 3524894 | 1/1987 | Fed. Rep. of Germany | 418/268 |
| 2154283 | 9/1985 | United Kingdom | 418/268 |

*Primary Examiner*—Richard A. Bertsch
*Assistant Examiner*—David L. Cavanaugh
*Attorney, Agent, or Firm*—Wall and Roehrig

[57] ABSTRACT

An articulated air vane air or hydraulic motor has a rotor core disposed coaxially in a cylindrical housing, with a plurality of articulating vanes that seat in axial sockets or slots in the rotor core. A crescent shaped insert defines a cam surface in the chamber between the housing and the core. Inlet and exhaust ports are formed either in the housing cylinder or in the end plates. Vane wear is significantly reduced and injected lubricant is not required. The vanes can be generally P-shaped in cross section, with stop structure to limit the articulating motor.

11 Claims, 4 Drawing Sheets

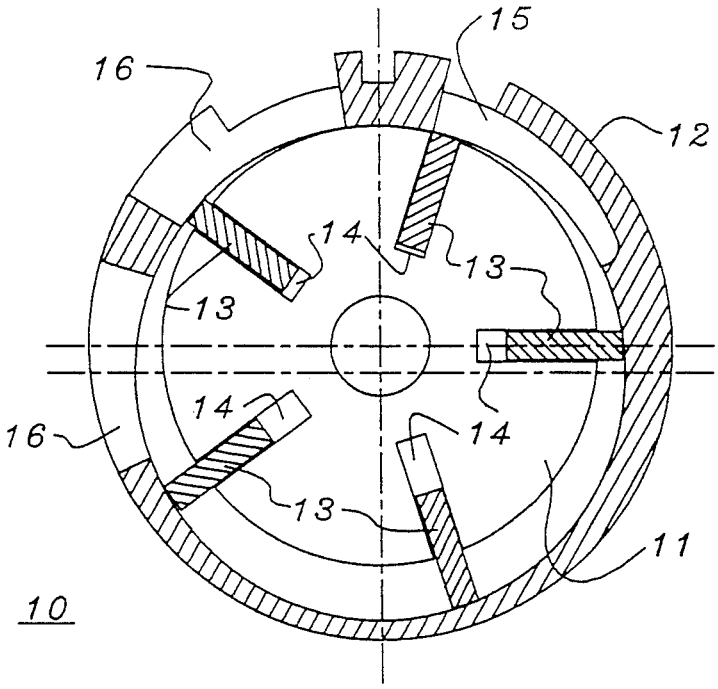
CONVENTIONAL PNEUMATIC MOTOR
FIG. 1A (PRIOR ART)
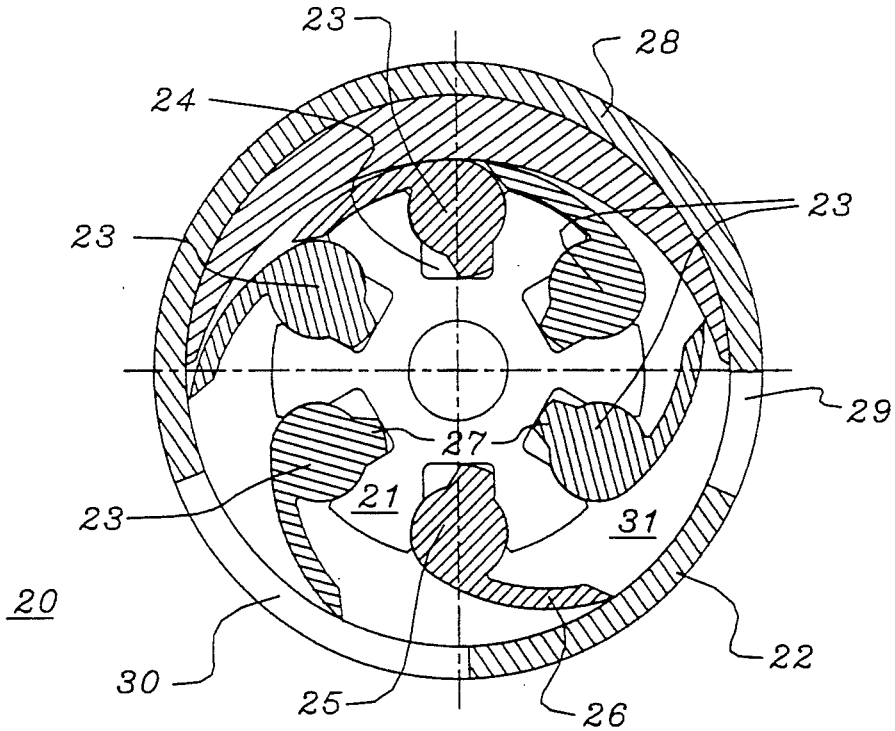
FIG. 1B
ARTICULATED VANE FLUID DRIVEN MOTOR
FIGURE 1

FOUR VANE MOTOR WITH END PORTING

COMPOSITE VANE

SPRING STEEL VANE

FIVE VANE MOTOR WITH STOP BUILT INTO ROTOR

MOTOR WITH INSERT AS INTEGRAL PART OF CYLINDER

ARTICULATED VANE FLUID DRIVEN MOTOR

BACKGROUND OF THE INVENTION

This invention is directed to fluid-type rotating machines, and is more particularly concerned with vane-type pneumatic and hydraulic motors.

Conventional pneumatic motors have a cylindrical rotor that rotates on an axis that is eccentric to the axis of a cylindrical chamber with vanes that contact against the wall of the chamber. High pressure air is directed into the core of the rotor, and the force of air pressure, together with centrifugal force urges the vane outward against the chamber wall. Wear of the vanes results from this outward force and from the surface contact velocity. The rate of vane wear is further increased due to limited contact surface of the vane with the cylindrical chamber wall. That is, because of the eccentric disposition of the rotor with respect to the cylindrical chamber, the rotor vane tips to not seat squarely against the chamber wall. As the vane travels from the near or compression side towards the far or expansion side, only the trailing edge of the vane is in contact. The zone of contact moves forward at full extension, and then only the leading edge of the vane is in contact as it travels back to the compression side. Conventionally, wear is controlled by limiting the speed of the motor, and by injection of a liquid lubricant into the drive air.

Also, conventional vane motors require side porting, i.e., porting through the cylindrical wall, which must deal with the problem of repressurization. This means that conventional vane motors either require extensive internal machined porting, or else use a housing around the cylinder which has cast and machined porting. It would be desirable to reduce the complexity of the parting, and also reduce manufacturing costs, but this goal has eluded vane motor designers.

A number of rotary pumps and motors have been proposed with modified vanes and chambers, but to date no one has combined whatever teachings there may be in these designs to produce a more durable, lower cost pneumatic or hydraulic rotary motor. A revolving sleeve rotary vane pump with pivoted vanes is shown in U.S. Pat. No. 2,841,090. A rotary motor with pivoting vanes and a floating piston in the chamber is described in U.S. Pat. No. 2,585,354. A rotary pump with pivoted vanes is described in U.S. Pat. No. 2,011,451. However, nothing in these previous designs suggests a simple design for a durable and reliable air motor or fluid driven motor.

OBJECTS AND SUMMARY OF THE INVENTION

It is an of this invention to provide a pneumatic or hydraulic motor which has a reduced wear characteristic for the rotor vanes, and which avoids the need for liquid lubricant.

It is another object to provide a vane type motor of simple design and construction which can be manufactured at relatively low cost, and which avoids the need for machining of elaborate intake and exhaust port structure.

A further object is to provide a highly reliable pneumatic or hydraulic motor that can be readily applied to pneumatic air tools.

According to one aspect of this invention, an articulated vane motor has a generally cylindrical rotor core that rotates about its axis and has a plurality of axial articulation slots or sockets formed in it at angularly spaced locations. A plurality of rotor vanes are mounted respectively in these articulation slots, so that there is at least some swinging motion permitted towards and away from the rotor core. The motor housing contains the rotor core and its vanes, and defines a fluid chamber which has a circumferential wall that contacts (or nearly contacts) the tips of the rotor vanes. This wall is cylindrical over a working portion of the chamber, and is coaxial with the rotor over this working portion. Here the chamber wall is spaced radially from the rotor core so that the vanes articulate radially outward in the working portion of the chamber. The housing has a cam portion in a zone outside the working portion. The cam portion reduces the radial spacing from the rotor core to the circumferential wall in this zone, and this deflects the rotor vanes radially inward towards the rotor core. Fluid inlet and outlet ports are provided, either on the circumferential housing wall or on the end plates to communicate a fluid pressure differential onto the vanes in the working portion to drive the core and vanes in rotation.

In one preferred mode the housing comprises a cylindrical sleeve, and the cam portion is in the form of an insert that is of crescent shaped cross section. In other embodiments the cam portion can be integrally formed in the housing. The vanes, core and housing can be extruded either of metal or of a durable plastic synthetic resin. In the latter case a lubricant filler can be incorporated into the vanes.

The articulated vanes can have a generally P-shaped cross section with a generally cylindrical portion that pivots in the articulation slot and a fin that extends from the cylindrical portion. The vanes can be formed integrally, or the cylindrical portion and fin can be formed as separate members and joined to one another. Stop means can be incorporated in the rotor core to limit the degree of articulation or swing of the vanes.

The above and many other objects, features, and advantages of this invention will become apparent from the ensuing detailed description of selected preferred embodiments, to be read in conjunction with the accompanying Drawing.

BRIEF DESCRIPTION OF THE DRAWING

FIG. 1A is a cross sectional view of a vane type motor according to the prior art.

FIG. 1B is a cross sectional view of an articulated vane type motor according to one embodiment of the present invention.

DETAILED DESCRIPTION OF THE PREFERRED EMBODIMENTS

Figure 2A:
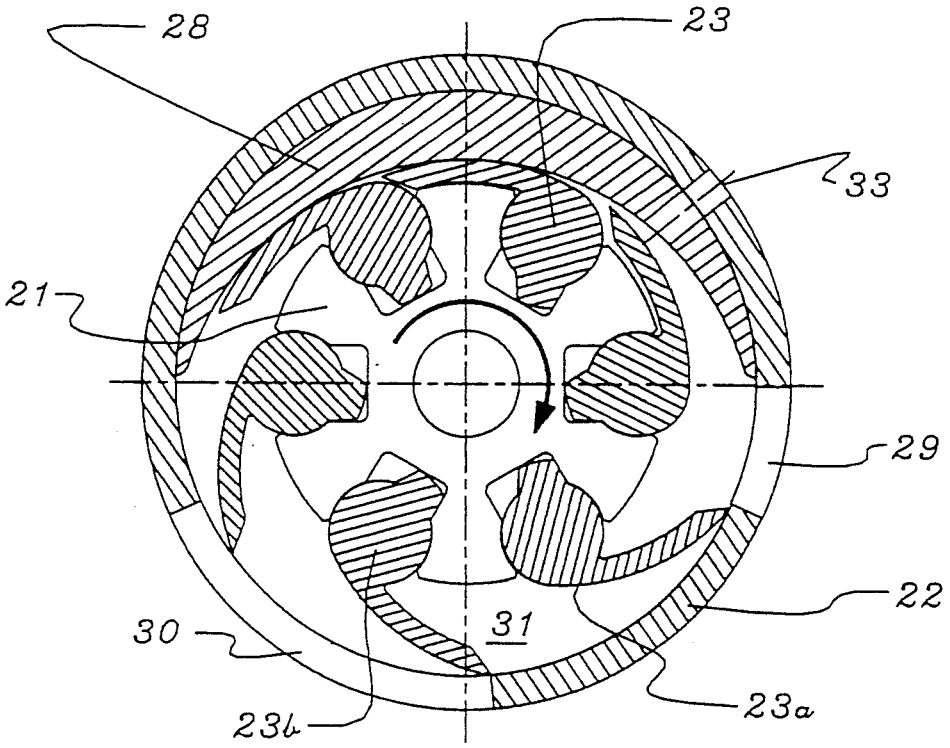
FIGS. 2A and 2B are cross sectional views of the FIG. 1B motor, for explaining its operation.

With reference to initially to FIG. 1A, a conventional pneumatic motor 10 has a generally cylindrical rotor core 11 disposed in a cylindrical housing 12. Rotor vanes 13 ride in axial slots 14 in the rotor core. The axis of the core 11 is spaced somewhat above the axis of the housing 12 so that the vanes 13 are retracted at the top of a cycle and are fully extended at the bottom. A compressed air inlet port 15 is situated on the down-turning side of the housing just after the top, and one or more exhaust ports 16 are formed in the housing on the up-turning side. During normal operation, the vanes 13 are forced radially outwards by a combination of centrifugal force and high pressure air directed into the rotor core 11 behind the vanes 13. These forces bring the tips of the vanes into contact with the inner cylindrical wall of the housing 12. Wear of these vanes 13 results from this force and from the surface contact velocity. The rate of vane wear is further increased to the limited contact surface of the vane tips with the housing 12. As the vane 13 travels clockwise and downward in FIG. 1A, the trailing edge only of the tip of the vane 13 is in contact with the housing wall. The contact zone shifts forward to the vane tip center at full extension (bottom center), and then finally transfers to the leading edge as the rotor vane rotates up to return to the top. Traditionally, vane wear is controlled by limiting the speed or RPM of the motor, and by injecting a liquid lubricant.

An example of an articulated vane motor 20 according to on embodiment of the present invention is shown in FIG. 1B. This motor 20 has a rotor core 21 that is coaxially disposed in a housing cylinder 22. There are a suitable number of articulated vanes 23 mounted into respective slot-type sockets 24 in the rotor core, so that the vanes 23 are evenly distributed over the circumference of the core. These vanes are generally shaped like the letter "P" in a cross section, with a generally cylindrical portion 25 that is seated in the associated socket 24 and a blade or fin 26 that extends from the portion 25 to the wall of the housing cylinder 22. The vanes each have a stop member in the form of a nose or protuberance 27 that abuts one wall of a recess in the respective socket 24 when the vane is fully extended.

A crescent shaped insert 28 is fitted onto the inner wall of the housing cylinder 22, here occupying nearly 180 degrees of arc.

A pressure inlet port 29 is provided on the downturning side just below the insert 28, and an exhaust port 30 is provided a circumferential distance after the inlet port. The circumferential wall of the housing cylinder 22 defines a pressure chamber within it around the rotor core 21, and includes a working region 31 that extends at least between the inlet and exhaust ports 29 and 30. In this region 31 the articulated vanes 23 extend outward so that the tips of their fins 26 reach the wall of the housing cylinder 22. In this region, the differential pressure between inlet and exhaust port pressures acts on the vane 23 to impose a torque and rotate the rotor core 21. In the zone occupied by the insert 28, the radial distance between the core 21 and the peripheral wall of the chamber is reduced. Here the insert 28 serves as a cam and repressurizes the gas or fluid between it and the rotor core 21. The pressure deflects the vanes 23 inwards as they pass through this zone. The narrow passage (at top centers) between the vanes and the insert blocks the air (or other fluid) as the vanes pass back towards the inlet port 29. The rotation or articulation of the vanes to the extended position is constrained by the nose 27 so that there is not intimate contact with between the vanes 23 and the cylindrical surface of the housing 22, thus eliminating wear in the working region. The angle that the vane 23 rotates in its respective socket 24 varies, depending on the configuration of the motor. In the configuration shown in FIG. 1A, the vane rotates outward approximately 60 degrees and returns to its retracted position through another sixty degrees, for a total rotation of 120 degrees over one full cycle of the rotor core 21. Because the diameter of the socket 24 is small, and the relative surface velocity of the sliding components, e.g. vane cylindrical portion 25 relative to the socket 24 is small, there is a low degree of wear of the contacting parts, i.e., vane 23 and rotor core 21 as compared with contacting parts (vanes and rotor pockets, or vanes and cylinder periphery) in the conventional vane motor.

The principle of operation of the articulated vane air motor is similar to that of a conventional air motor, with differential pressure across the vane 23 providing the driving force. Here the differential pressure occurs because of the crescent shaped cam insert 28. The insert represents a deviation from a true cylinder in the zone outside the working region.

Figure 2B:
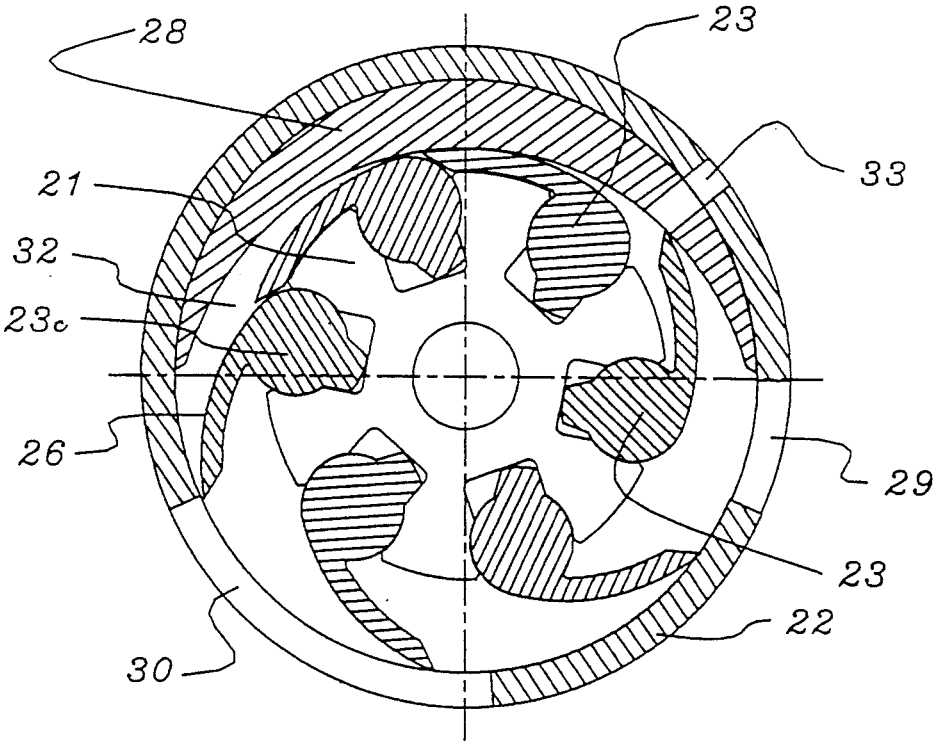

With reference now to FIGS. 2A and 2B, and first considering the extended vane 23 in the working region 31, it is apparent that there is a differential pressure appearing across this vane as it sweeps between the inlet port 29 and the exhaust port 30.

This produces a moment force that is applied to the core 21, thus imposing a torque on it and causing it to rotate (clockwise in these drawing figures).

As the rotor core 21 and vanes 23 move in the clockwise direction, the descending vane **23*a* closes off the inlet port 29 from the working region 31 of the chamber, and the previous vane 23*b* begins to the open the working region to the exhaust port 30. At this time an ascending vane 23*c* begins to reach the far end of the exhaust port 30, and traps air in a region 32, where repressurization occurs. The increasing pressure acts on the fin 26 of the vane 23*c* to pivot it to its retracted position, and most of the air escapes over the tip of the vane towards the exhaust port 30. Some of the air remaining forms a layer of air to cushion the vane from the insert 28 at the point (top center in these figures) where clearance over the rotor core is smallest. Shallow V-grooves can be cut in the outer or back side of the vanes parallel to the axis of rotation. These grooves would provide enhanced cushion effect and create a turbulent zone to preclude air flow from the high pressure side. Beyond this point, on the down turning side, above the inlet port 29 there is some depressurization, which can hinder the extending outward of the vanes 23. However, this can be overcome by metering pressurized supply air via an auxiliary port 33 through the housing 22 and insert 28 in advance of the main air inlet port 29. This permits the vanes 23** to swing out at higher rotational speeds. An auxiliary port through the insert is not needed if an end-ported design is selected.

It is preferred to vent the radially inward portions of the sockets 24 to the atmosphere which can be achieved with circular grooves formed on associated end plates. This reduces the effect of centrifugal force on the vanes 23, and it isolates the rotor bearings from high pressure air. Also, the exhaust chamber is significantly larger than the working region or the inlet portion of the fluid chamber. This has a damping effect on pressure pulses, and thereby reduces exhaust noise.

Figure 3:
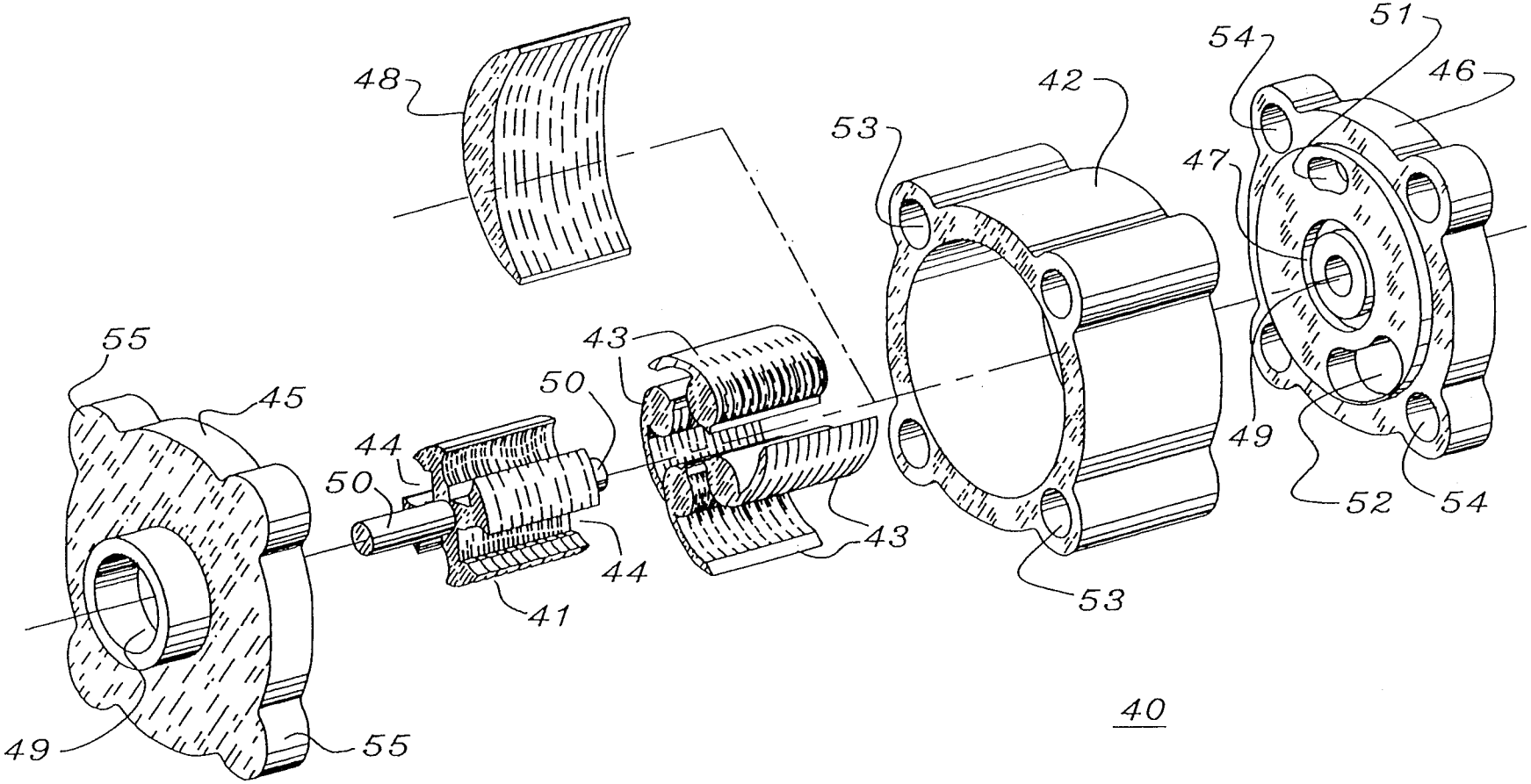
FIG. 3 is an exploded assembly view of a motor according to another preferred embodiment.

FIG. 3 is an exploded assembly view of a motor according to an embodiment of this invention, but which employs end plate porting rather than housing cylinder porting, and employs only four articulated vanes rather than six of the earlier described embodiment. This embodiment is shown as an example of the construction of a motor of this invention.

Figure 4:
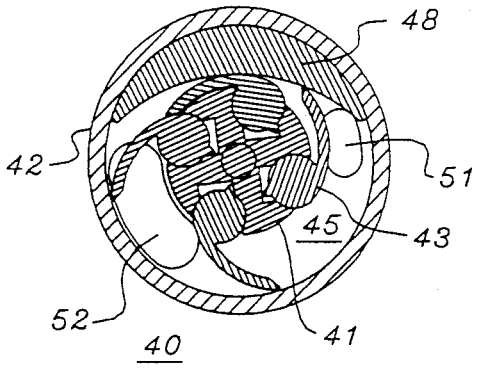
FIG. 4 is a cross sectional view of the motor of FIG. 3.

Here a rotor core 41 which is generally cylindrical with four axial slot sockets 44 spaced at 90 degree intervals accommodates four articulated vanes 43 and the assembly of the rotor core and vanes fits within a generally cylindrical housing 42 in which a crescent shaped insert 48 is fitted. First and second end plates 45, 46 each have an annular groove 47 which is vented to the atmosphere and which surrounds a bearing 49 that holds a shaft 50 of the rotor core 41. The end plate 46 has an inlet port 51 and an exhaust port 52 formed in it at angularly separated locations. The plates 45, 46 and the cylinder 42 are held together by threaded fasteners (not shown) that pass through openings in ears 53 and 54 in the cylinder 42 and plates 54 and fasten to ears 55 in the end plate 45. The assembled motor is shown in cross section in FIG. 4, which illustrates the relation of the end plate ports 51 and 52 and the insert 48.

The rotor core, cylinder, and end plates could be manufactured according to current method and techniques, employing conventional materials. However, the vanes 43 could be extruded of metal or other materials, injection molded of a plastic synthetic resin, or die cast of any of a variety of metals or resin materials, depending upon the size and application of the motor.

For reasons discussed previously, tolerances do not need to be as tight as previous vane motor designs, and so the amount of machining required is significantly reduced. Moreover, as contact between the vane tips and the cylinder is reduced or eliminated, substitutions can be made, both in materials and fabrication, to reduce the manufacturing costs further. Aluminum, zinc, or lightweight, low-cost alloys can be employed, and many modern plastic synthetic resins are available. The cylinder, insert, vanes, and core can be injection molded, die cast, or extruded.

Figure 5A:
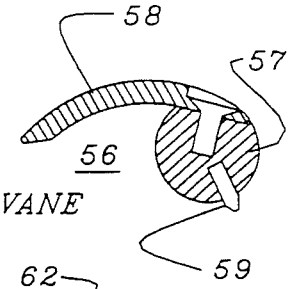
FIGS. 5A and 5B are cross sections of alternative articulated vanes.
Figure 5B:
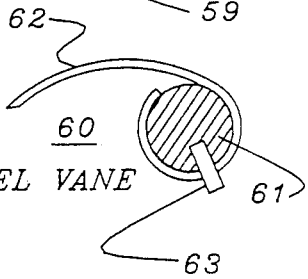

FIGS. 5A and 5B illustrate alternative construction concepts for the articulated rotor vanes of this invention. A composite vane 56 (FIG. 5A) has a cylindrical portion 57 and a blade or fin 58 formed separately and bolted or fastened together. The cylindrical portion 57 and a blade 58 can be of the same or different materials. A pin 59 can serve as a limit or stop. A spring steel vane 60 (FIG. 5B) has a cylindrical core 61 around which a spring steel fin 62 is fitted and held in place by a projecting pin 63. The pin 63 serves also as a stop or nose.

Figure 6:
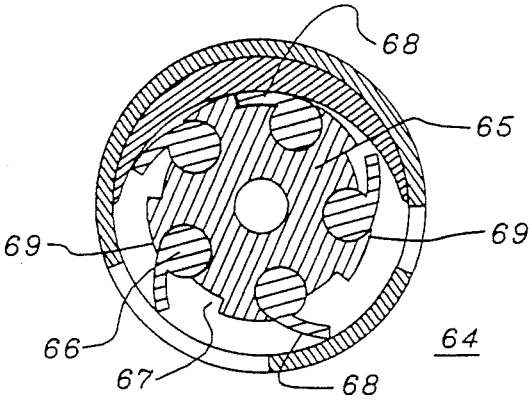
FIGS. 6 and 7 are cross sectional views of further motors according to alternative embodiments of this invention.

FIG. 6 shows a further motor 64 in which the rotor core 65 and vanes 66 are constructed so as to include stop means in the core. Here the rotor core periphery includes stepped recesses 67 which permit the fins 68 of the vanes to lie at the core circumference when the vanes 66 are recessed. A wedge shaped edge 69 limits outward deflection of the vanes 66.

Figure 7:
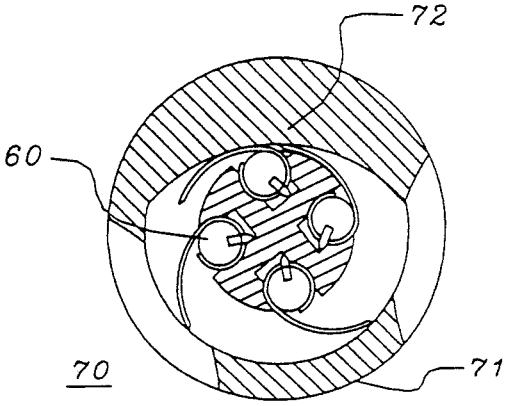

FIG. 7 shows a further motor 70 which employs spring steel articulated vanes 60, and in which the housing cylinder 71 has a cam portion 72 integrally formed in it, rather than employing a separate crescent shaped insert as in the previous embodiments. This motor 70 can be miniaturized easily for a number of small-motor applications.

While this invention has been described in detail in respect to a few selected embodiments, it should be appreciated that the invention could be applied to a wide range of pneumatic and hydraulic rotating machines. Many modifications and variations of these embodiments would present themselves to those of skill in the art, without departing from the scope and spirit of this invention, as defined in the appended claims.

What is claimed is:

1. An articulated vane fluid drive motor which comprises a generally cylindrical rotor core having a rotational axis and a plurality of axial articulation slots disposed at angularly spaced locations thereon; a plurality of articulating rotor vanes mounted respectively in said articulation slots; a housing containing said rotor core and rotor vanes and defining a fluid chamber which has a circumferential wall contacting tips of said vanes and which is cylindrical over a working portion of the chamber, the wall of said working chamber being coaxial with said rotor core and spaced radially from said core so that the said vanes are articulated radially outward in said working portion, said housing including a cam portion in a zone outside said working portion which reduces the radial spacing from the rotor core to said circumferential wall in said zone for creating a differential pressure in said working portion and repressurizing fluid in said zone thus deflecting the rotor vanes towards said rotor core; and fluid port means in said housing for communicating a fluid pressure into said working portion of said chamber to drive said rotor core and vanes in rotation.

2. The articulated vane motor of claim 1 wherein said housing includes a cylindrical cavity and said cam portion includes a generally crescent shaped insert affixed in said cylindrical cavity in said zone.

3. The articulated vane motor of claim 1 wherein said cam portion is integrally formed in said housing.

4. The articulated vane motor of claim 1 wherein said vanes are generally P-shaped in cross section, each with a generally cylindrical portion retained in an associated one of said articulation slots, and a fin which extends therefrom.

5. The articulated vane motor of claim 4 wherein said vanes are extruded.

6. The articulated vane motor of claim 4 wherein said vanes are injected molded of a plastic resin.

7. The articulated vane motor of claim 4 wherein said vanes each include a spring steel fin portion affixed onto a generally cylindrical core.

8. The articulated vane motor of claim 4 wherein said cylindrical portion and said fin portion are separate members affixed onto one another.

9. The articulated vane motor of claim 1 wherein said rotor core includes stop means for each of said rotor vanes to limit radially outward and radially inward deflection of said vanes.

10. The articulated vane motor of claim 1 wherein said housing includes end plates defining axial limits of said fluid chamber, and wherein said fluid port means includes an inlet port and an exhaust port which penetrate through at least one of said end plates.

11. The articulated vane motor of claim 9 wherein said stop means includes a recess formed in each of said articulation slots, and the associated vanes each have a projecting nose on a cylindrical articulating portion thereof, said nose contacting edges of said recess to define limits of articulated movement of the vane.

* * * * *